US005609069A

United States Patent [19]

Swenson

[11] Patent Number: 5,609,069

[45] Date of Patent: Mar. 11, 1997

[54] FOOT PEDAL ASSEMBLY

[75] Inventor: Dale Swenson, Wales, Wis.

[73] Assignee: Harley-Davidson Motor Company, Milwaukee, Wis.

[21] Appl. No.: 505,517

[22] Filed: Jul. 21, 1995

[51] Int. Cl.[6] ..... G05G 1/16

[52] U.S. Cl. ..... 74/563; 74/560

[58] Field of Search ..... 74/512, 513, 514, 74/560, 561, 562, 563, 562.5

[56] References Cited

U.S. PATENT DOCUMENTS

| | | | |
|---|---|---|---|
| 1,210,016 | 12/1916 | Sunden | 74/563 |
| 1,292,780 | 1/1919 | Grant | 74/563 |
| 1,379,561 | 5/1921 | Hathaway | 74/563 |
| 2,514,414 | 7/1950 | Pomernacki | 74/562 |
| 2,969,691 | 1/1961 | Cherry | 74/560 |

FOREIGN PATENT DOCUMENTS

| | | | |
|---|---|---|---|
| 450292 | 8/1948 | Canada | 74/561 |
| 9528 | of 1913 | United Kingdom | 74/563 |

OTHER PUBLICATIONS

Custom Chrome, Inc. Sales catalog, Floorboard Pads and Kits, pp. 97–99, 1995.

Drag Specialties Sales catalog, Brakes, p. 418, 1995.

Drag Specialties Sales catalog, Chassis, Suspension, Fenders & Footpegs, pp. 489–492, 1995.

*Primary Examiner*—Rodney H. Bonck
*Assistant Examiner*—Mary Ann Battista
*Attorney, Agent, or Firm*—Michael, Best & Friedrich

[57] ABSTRACT

A foot pedal and pad assembly having a foot pedal, a pad positioned adjacent to the foot pedal, and fastener for securing the pad to the foot pedal. A resilient member is secured to the head portion of the fastener. A bracket member is positioned between the fastener member and the pad. The bracket member includes a hole for insertably receiving the fastener member, and a plurality of openings for insertably receiving a plurality of raised portions extending up from a base portion of the pad.

12 Claims, 4 Drawing Sheets

FOOT PEDAL ASSEMBLY

FIELD OF THE INVENTION

The present invention generally relates to the field of foot pedals (e.g., brake pedals or shift pedals) for motor vehicles (e.g., motorcycles). More specifically, the present invention relates to foot pedals that are enhanced by the provision of a resilient member in order to provide cushioning and dampen vibration between the foot pedal and a user's foot.

BACKGROUND OF THE INVENTION

Foot pedals provide a means for activating various components on a motorcycle, such as a brake or a shifter. Typically, motorcycles include a brake pedal on one side of the motorcycle to facilitate baking, and a shift pedal on the other side to facilitate shifting. The foot pedals are commonly secured directly to the frame or engine of the motorcycle, and extend horizontally outward from the frame.

It has been found that a foot pedal is enhance by the provision of a resilient member, or pad, to the foot pedal. Such a pad advantageously cushions the foot pedal to enlarge the contact area between the foot pedal and the user's foot, thereby distributing the forces applied by the user's foot over a larger surface area. In addition, such pads dampen the shocks and vibrations that are transferred from the motorcycle to the user's feet. Foot pedal pads have traditionally been made from rubber and other resilient materials.

Foot pedal pads can take many different forms, depending on the particular foot pedal that they are applied to. For example, if the foot pedal is in the form of a horizontally-extending post (e.g., square or round in cross-section), the corresponding pad can be a tubular member having an open end that fits over the post. Alternatively, if the foot pedal is a flat surface, the corresponding pad can be a flat sheet that is secured (e.g., using adhesive) to the top surface of the foot pedal.

The above-described foot pedal pads are adequate for most uses. However, it has been found that the large amount of exposed rubber on the pad, which tends to have a dull texture, can detract from the aesthetics of the motorcycle. In addition, the techniques used to secure the pads to the foot pedals are sometimes inadequate, resulting in many pads becoming detached from the foot pedal long before the pad's useful life is complete.

SUMMARY OF THE INVENTION

Accordingly, it is an object of the present invention to provide a foot pedal and pad assembly that enhances the overall structure and appearance of the motorcycle, while still providing a functional foot pedal pad. It is another object of the present invention to improve the techniques for securing a pad to a foot pedal. It is a related object of the present invention to provide a technique that maintains the pad secured to the foot pedal throughout the pad's useful life, and further facilitates easy removal and replacement of the pad after the pad has worn out.

The foot pedal and pad assembly of the present invention comprises a foot pedal, a pad (e.g., a resilient rubber material) positioned adjacent to the foot pedal, and fastener means (e.g., a threaded fastener)for securing the pad to the foot pedal. The fastener means includes a fastener member having a shaft portion and a head portion, and a resilient member (e.g., a rubber material) secured (e.g., vulcanized) to the head portion. By providing the resilient material to the head portion of the fastener member, the fastener member cannot be seen from the top of the foot pedal, thereby enhancing the appearance of the foot pedal. In addition, provision of the resilient member to the head portion increases the frictional characteristics of the fastener member and dampens vibration between the user's foot and the fastener member, thereby improving the functional aspects of the foot pedal. Preferably, the resilient member extends down along the sides of the head portion to provide vibration damping between the fastener member and the foot pedal, thereby further damping vibration transmitted through the fastener member.

In one embodiment, the foot pedal and pad assembly further includes a bracket member positioned between the fastener member and the pad. For example, the bracket member can include a hole for insertably receiving the fastener member. In addition, the bracket member can include an opening (e.g., a plurality of openings) for insertably receiving a raised portion (e.g., a plurality of raised portions) extending up from a base portion of the pad. Preferably, the bracket member comprises a chrome plating.

The present invention is also embodied in a method of securing a pad to a foot pedal utilizing a fastener member having a head portion. The method includes the steps of securing (e.g., vulcanizing) a resilient member to the head portion of the fastener member, positioning the pad adjacent to the foot pedal, and inserting the fastener member through the pad and into the foot pedal.

The present invention is also embodied in a method of securing a pad having a raised portion to a foot pedal. The method includes the steps of inserting the raised portion through an opening in a bracket, positioning the pad adjacent to the foot pedal, and securing the bracket to the foot pedal. Preferably, the step of securing comprises the step of inserting a fastener through the bracket and into the foot pedal.

DETAILED DESCRIPTION

Figure 1:
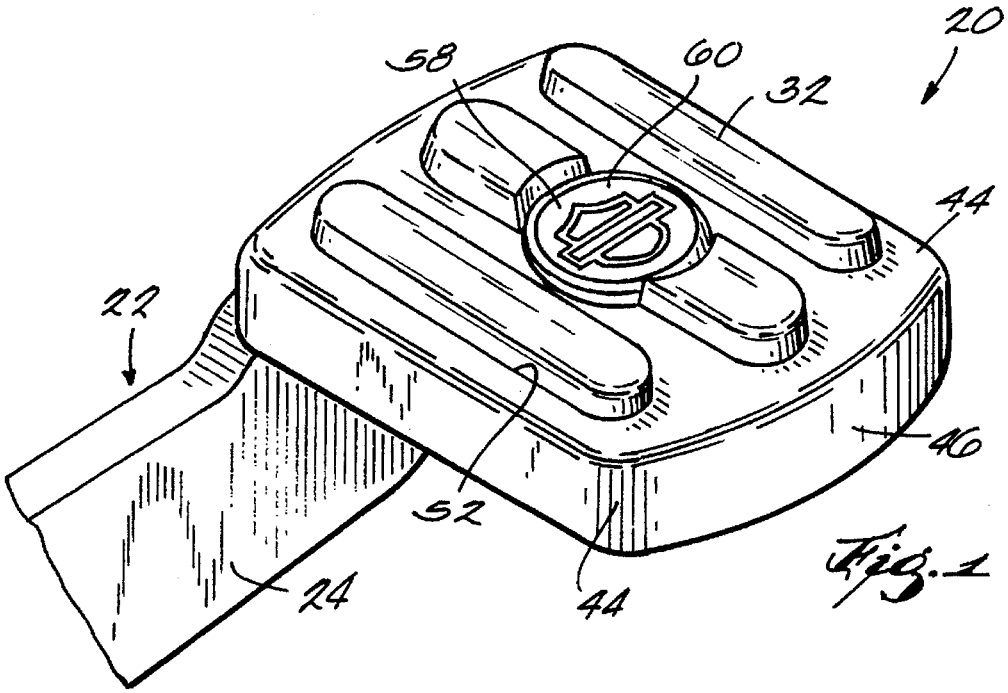
FIG. 1 is a perspective view of a foot pedal and pad assembly embodying the present invention.
Figure 2:
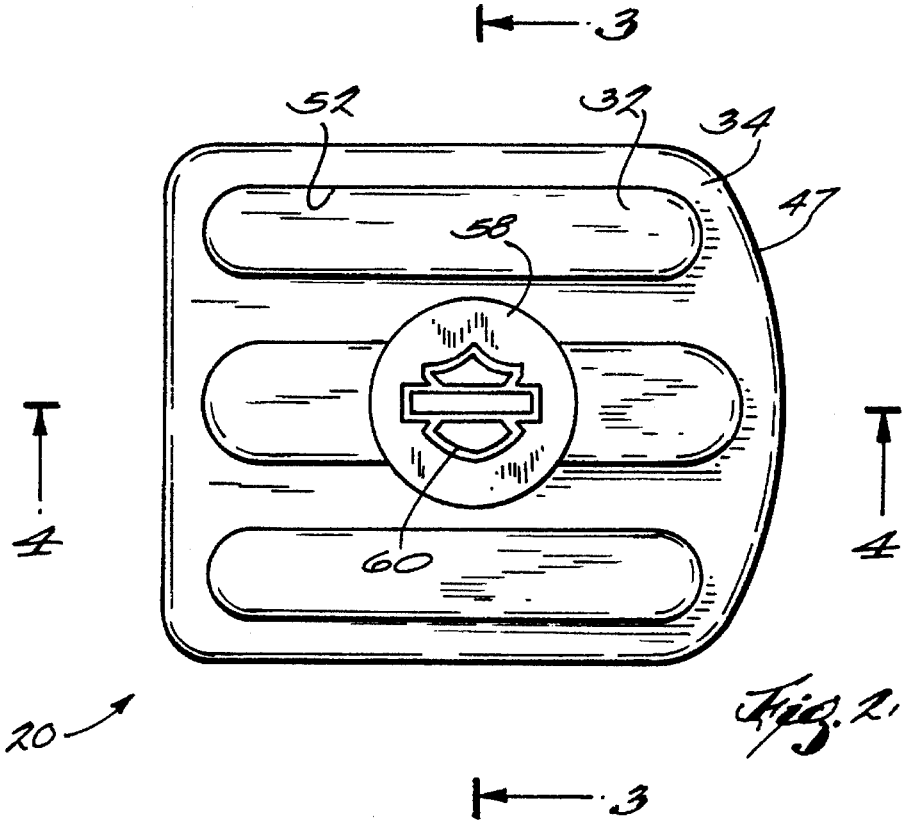
FIG. 2 is a top view of the assembly illustrated in FIG. 1.
Figure 3:
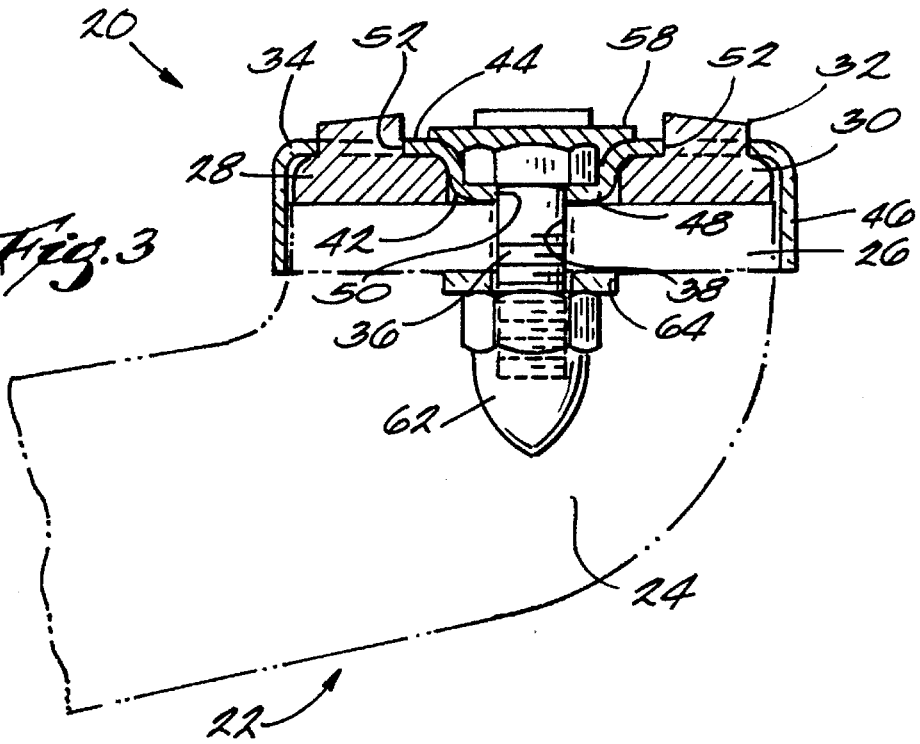
FIG. 3 is a section view taken along line 3—3 in FIG. 2.
Figure 5:
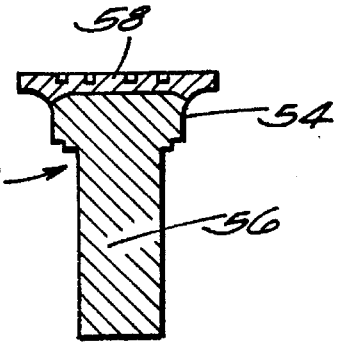
FIG. 5 is a section view of the fastener member illustrated in FIGS. 3 and 4.
Figure 4:
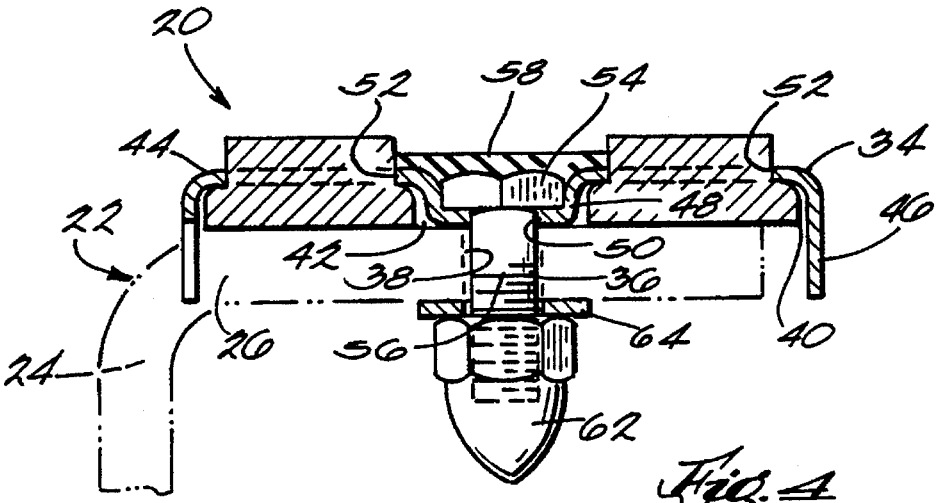
FIG. 4 is a section view taken along line 4—4 in FIG. 2.

FIGS. 1–4 illustrate a brake pedal assembly 20 embodying the present invention. The assembly 20 generally includes a brake pedal 22 having an arm 24 extending from the motorcycle (not shown), and a platform 26 extending outwardly from the arm 24. A resilient pad 28 is positioned on the platform 26, and includes a base portion 30 and a plurality of raised portions 32 extending upwardly from the base portion 30. A cover bracket 34 is positioned over the resilient pad 28, and is secured to the platform 26 by a fastener member 36.

The platform 26 is formed integral with the arm 24, and includes a hole 38 for insertably receiving the fastener member 36. The platform 26 is generally rectangular in shape and is dimensioned to withstand the forces encountered by a typical brake pedal.

The resilient pad 28 is also generally rectangular in shape and also has an arcuate outer edge 40 that extends beyond the outer edge of the platform 26. The resilient pad 28 also includes a central hole 42 for insertably receiving the fastener member 36. The raised portions 32 of the resilient pad 28 are about 8 mm wide and extend upwardly from the base portion 30 about 2–3 min.

The resilient pad 28 comprises a resilient material that can withstand shock loads and dampen vibrations. For example, the resilient pad 28 may comprise rubber, polyurethane or any other suitable resilient material. In the illustrated embodiment, the resilient pad 28 comprises black rubber SBR having a hardness of 60 durometer.

The cover bracket 34 includes a generally planar upper surface 44 having a downwardly-extending skirt portion 46 extending around the perimeter of the upper surface 44. The cover bracket 34 is generally rectangular in shape, and has an arcuate outer edge 47 that extends beyond the outer edge of the platform 26. The cover bracket 34 further includes a centrally-located recessed portion 48 that is dimensioned to fit within the central hole 42 in the base portion 30 of the resilient pad 28. The recessed portion 48 is hexagonally-shaped when viewed from the top to facilitate insertion and engagement of the fastener member 36, as described below in more detail. In this regard, the recessed portion 48 further includes a hole 50 for insertably receiving the fastener member 36. The upper surface 44 of the cover bracket 34 further includes a plurality of openings 52 dimensioned to insertably receive the raised portions 32 of the resilient pad 28. The cover bracket 34 of the illustrated embodiment is chrome plated to blend in with the motorcycle to which it will be mounted.

The above-mentioned fastener member 36 includes a head portion 54 and a shaft portion 56. The fastener member 36 is designed to be inserted into the recessed portion 48 of the cover bracket 34 and through the hole 38 in the platform 26 of the brake pedal 22. In the illustrated embodiment, the fastener member 36 is a hexagonal head bolt.

A resilient member 58 is secured to the upper surface of the head portion 54. The resilient member 58 can comprise any suitable resilient material, but preferably comprises the same material as the above-described resilient pad 28. In the illustrated embodiment, the resilient member 58 is vulcanized to the head portion 54. Advantageously, the resilient member 58 can include text or a logo 60 identifying the source of the motorcycle. In addition, it is preferred to have the material of the resilient member 58 extend down along the sides of the head portion 54, thereby providing vibration damping between the fastener member 36 and the cover bracket 34. For example, about 0.01–0.25 mm of resilient material along the sides of the head portion 54 can be provided. An acorn nut 62 and corresponding washer 64 are provided to secure the fastener member 36 in place.

The provision of the resilient member 58 improves the structure and appearance of the brake pedal 22 in several ways. For example, the resilient member 58 covers the fastener member 36, thereby improving the aesthetics of the brake pedal 22 when viewed from the top. In addition, since the resilient member 58 is made from the same or similar material as the resilient pad 28, the resilient member continues the aesthetics of the raised portions along the length of the brake pedal 22. Also, the resilient member 58 increases the frictional coefficient of the top surface of the head portion, thereby improving frictional interaction between the brake pedal and the operator's feet.

The above-described assembly 20 is assembled in the following manner. First, the resilient pad 28 is inserted into the cover bracket 34 such that the raised portions 32 of the resilient pad 28 extend through the openings 52 in the cover bracket 34. The resilient pad 28 is then positioned on top of the platform 26 of the brake pedal 22 such that the skirt portion 46 of the cover bracket 34 covers the sides of the platform 26. The resilient member 58 is then vulcanized to the head portion 54 of the fastener member 36, and the fastener member 36 is then inserted through the holes 42, 38 in the cover bracket 34 and the platform 26 until the head portion 54 is positioned within the recessed portion 48 of the cover bracket 34. The fastener member 36 is then secured in place utilizing the washer 64 and acorn nut 62.

Figure 6:
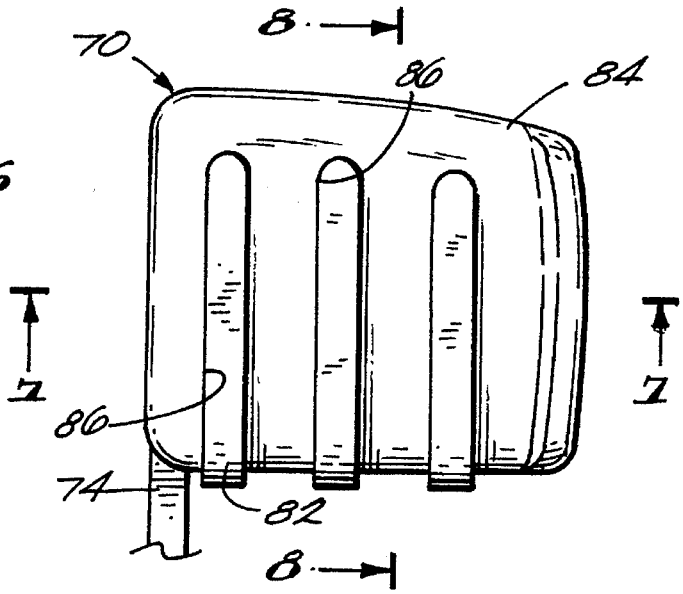
FIG. 6 is a top view of an alternative embodiment of the present invention.
Figure 8:
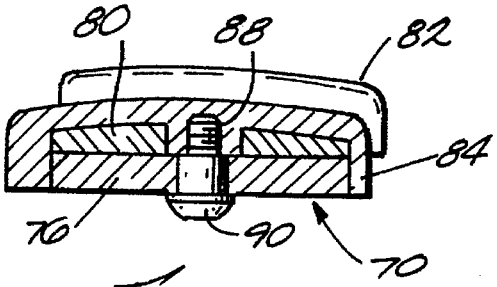
FIG. 8 is a section view taken along line 8—8 in FIG. 6.
Figure 7:
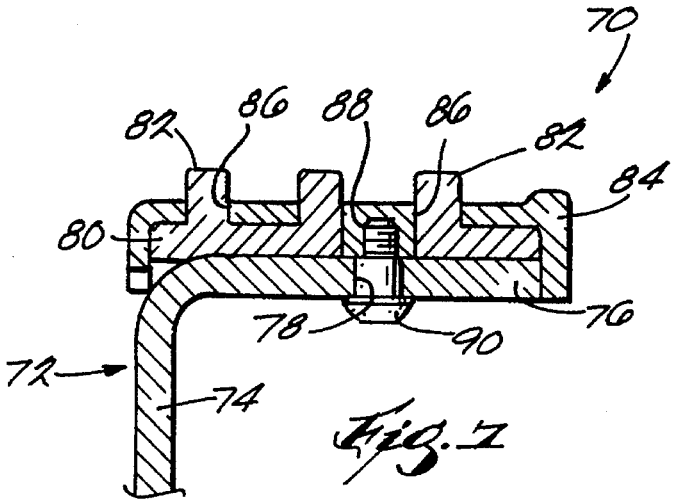
FIG. 7 is a section view taken along line 7—7 in FIG. 6.

FIGS. 6–8 illustrate another brake pedal assembly 70 embodying some aspects of the present invention. The illustrated assembly 70 includes a brake pedal 72 having an arm 74 and a platform 76 having a hole 78 extending through a central portion thereof. A resilient pad 80 is positioned on the platform 76 and includes a plurality of upwardly-extending raised portions 82. A cover bracket 84 is positioned over the resilient pad 80 and includes a plurality of openings 86 for insertably receiving the raised portions 82 of the resilient pad 80. The cover bracket 84 further includes a threaded orifice 88 that facilitates securing the cover bracket 84 to the platform 76 utilizing an appropriate fastener 90. As is best shown in FIG. 8, the raised portions 82 of the resilient pad 80 extend not only upwardly through the cover bracket 84, but also outwardly (i.e., to the side) on one side of the cover bracket 84.

Figure 9:
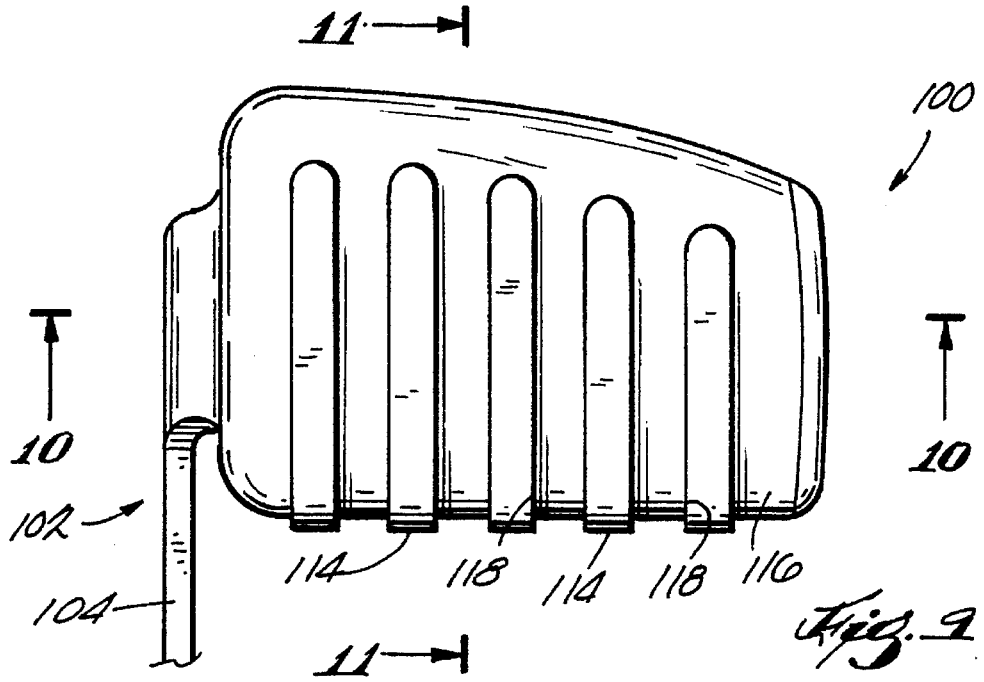
FIG. 9 is a top view of yet another alternative embodiment of the present invention.
Figure 10:
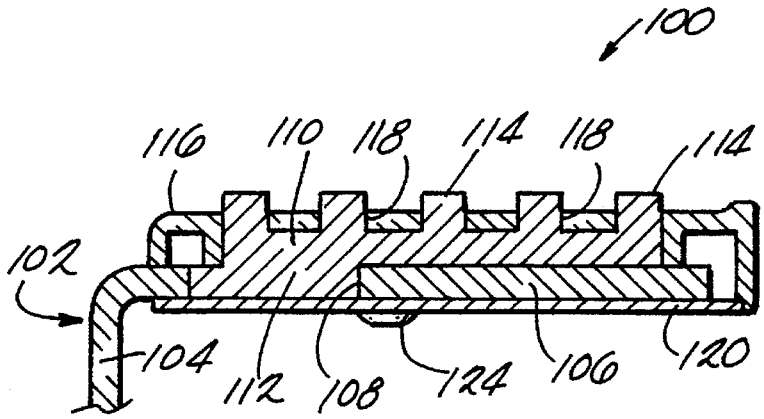
FIG. 10 is a section view taken along line 10—10 in FIG. 9.
Figure 11:
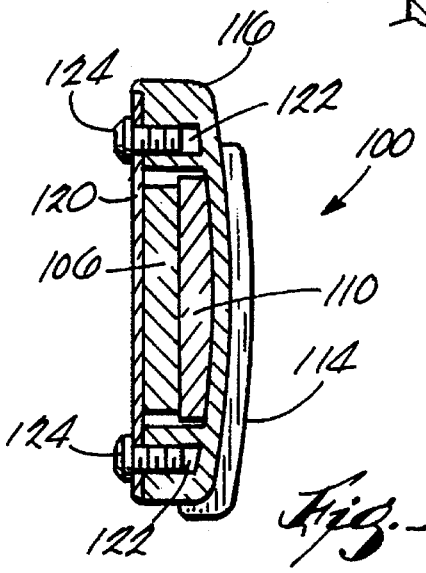
FIG. 11 is a section view taken along line 11—11 in FIG. 9.

FIGS. 9–11 illustrate yet another brake pedal assembly 100 embodying some features of the present invention. The illustrated assembly 100 includes a brake pedal 102 having an arm 104 and a platform 106 having a hole 108 extending therethrough for receiving a portion of a resilient pad 110. The resilient pad 110 is positioned on the platform 106 and includes a downwardly-depending portion 112 positioned within the hole 108 in the platform 106. In addition, the resilient pad 110 includes a plurality of upwardly-extending raised portions 114. A cover bracket 116 is positioned over the resilient pad 110 and includes a plurality of openings 118 for insertably receiving the raised portions of the resilient pad 110. A lower plate 120 is positioned below the platform 106 and extends laterally beyond the edge of the platform 106. The cover bracket 116 further includes at least two threaded orifices 122 that facilitate securing the cover bracket 116 to the lower plate 120 utilizing an appropriate fastener 124, thereby sandwiching the platform 106 and resilient pad 110 therebetween.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A foot pedal and pad assembly comprising:

a foot pedal;

a resilient pad positioned adjacent to said foot pedal; and fastener means for securing said pad to said foot pedal, said fastener means including:

a fastener member having a shaft portion and a head portion; and a resilient member covering said head portion and directly secured only to said head portion.

2. An assembly as claimed in claim 1, wherein said pad comprises a resilient material.

3. An assembly as claimed in claim 2, wherein said pad comprises rubber.

4. An assembly as claimed in claim 3, wherein said resilient member comprises rubber that is substantially the same as said pad.

5. Art assembly as claimed in claim 1, wherein said fastener member comprises a threaded fastener.

6. An assembly as claimed in claim 1, wherein said resilient member comprises rubber.

7. An assembly as claimed in claim 6, wherein said resilient member is vulcanized directly to said head portion of said fastener member.

8. An assembly as claimed in claim 1, further comprising a bracket member positioned between said fastener member and said pad.

9. An assembly as claimed in claim 8, wherein said pad includes a raised portion, and wherein said bracket member includes:

a hole for insertably receiving said fastener member; and an opening for insertably receiving said raised portion.

10. An assembly as claimed in claim 9, wherein said pad includes a plurality of raised portions, and wherein said bracket member includes a plurality of openings for insertably receiving said raised portions.

11. A method of securing a resilient pad to a foot pedal utilizing a fastener member having a head portion, comprising the steps of:

directly securing a resilient member to the head portion of the fastener member in such a manner that the resilient member covers the head portion;

positioning the resilient pad adjacent to the foot pedal; and inserting the fastener member through the resilient pad and into the foot pedal to secure the resilient pad to the foot pedal.

12. A method as claimed in claim 11, wherein said step of securing comprises the step of vulcanizing the resilient member to the head portion.

* * * * *